United States Patent [19]

Hanyu et al.

[11] Patent Number: 4,721,049

[45] Date of Patent: Jan. 26, 1988

[54] SELECTING MECHANISM OF A DOUBLE-FUNCTION SEWING MACHINE

[75] Inventors: Susumu Hanyu; Akio Koide, both of Tokyo, Japan

[73] Assignee: Janome Sewing Machine Co., Ltd., Tokyo, Japan

[21] Appl. No.: 33,032

[22] Filed: Mar. 30, 1987

[30] Foreign Application Priority Data

Apr. 11, 1986 [JP] Japan ..... 61-53488

[51] Int. Cl.[4] ..... D05B 1/14

[52] U.S. Cl. ..... 112/168

[58] Field of Search ..... 112/168, 163, 2, 155

[56] References Cited

U.S. PATENT DOCUMENTS 4,438,716 3/1984 Koide et al. ..... 112/168

4,445,450 5/1984 Ebata ..... 112/168 X 4,498,405 2/1985 Hanyu et al. ..... 112/168

*Primary Examiner*—Peter Nerbun

*Attorney, Agent, or Firm*—Michael J. Striker

[57] ABSTRACT

In a sewing machine having two mechanisms different in sewing functions installed within one machine frame a single drive motor is provided and functions are alternately actuated by means of a clutch mechanism. Transmission of a driving force is made by keys and corresponding key grooves, and a selection mechanism has a switch-checking device for avoiding an erroneous operation. A release device of the switch-checking device is actuated by operation of the flywheel, to avoid dangers of erroneous switching during operation.

5 Claims, 11 Drawing Figures

SELECTING MECHANISM OF A DOUBLE-FUNCTION SEWING MACHINE

BACKGROUND OF THE INVENTION

The present invention relates to a double-function sewing machine which is equipped with two mechanisms different in sewing functions, within a single machine frame.

A known double function sewing machine is provided with a single drive motor which is selectively actuated by a clutch mechanism for respectively driving the stitch forming mechanisms.

Known devices for selecting the sewing functions in the sewing machine by switching a clutch mechanism, have one mechanism which is dangerous due to an erroneous operation during driving the sewing machine another where switching phases are limited, and a main shaft which is made non-selected after having been switched by a manual operation, and is rotated less than one rotation until a mechanical switching is completed. In other devices the above mentioned defects are avoided by limiting the switching phase during stopping of the operation and by enabling to switch only by maintaining equal the switching phase of the two functions.

Conventional devices are high in production costs, since the phase control should be precise when setting up the devices.

SUMMARY OF THE INVENTION

It is an object of the present invention to provide an improved sewing machine.

The object of the invention is attained by a sewing machine including two mechanisms different in sewing functions in a single machine frame; a drive shaft which is rotatably supported in the machine frame and is connected at its one end with an axially movable flywheel and is driven by a drive source via a belt wheel body; a belt wheel which is non-rotatable on the drive shaft and is connected to a first stitching mechanism via a belt, having a transmission part to said drive source; an upper shaft belt wheel which is secured on an upper shaft of a second stitching mechanism rotatably supported in the machine frame, coaxially with the drive shaft and having a transmission part to the drive source; a slider which is provided between said two belt wheels, having a rotation transmitting part for selectively engaging either of the two belt wheels and rotation-fixed with the drive shaft and movable in the axial direction; a switching shaft which is rotatably supported in the machine frame and is rotated by an external switching operation; means for moving the slider to connect the slider to the switching shaft; a rotation checking means for the switching shaft; and a release device which releases the rotation checking means by axially moving the flywheel.

The switching operation is carried out by axially moving the flywheel to release the rotation checking means. The stitch forming mechanism is selected by rotating the switching shaft to axially move the slider on the drive shaft by moving means connecting the slider to said switching shaft, and selectively engaging either of the belt wheels connected to the first stitching mechanism or the upper shaft belt wheel connected to the second stitching mechanism. When the flywheel is axially moved after said selection, the rotation checking means is actuated to stop the rotation with respect to the selection of the stitch forming mechanism of the switching shaft. The driving of the stitch forming mechanism causes rotation of the drive shaft via the belt wheel body by the drive source or manual rotation of the flywheel, so as to rotate the slider-rotation fixed with the drive shaft and rotate either one of the two belt wheels connected to the slider via the transmission parts.

THE PREFERRED EMBODIMENTS

Figure 10:
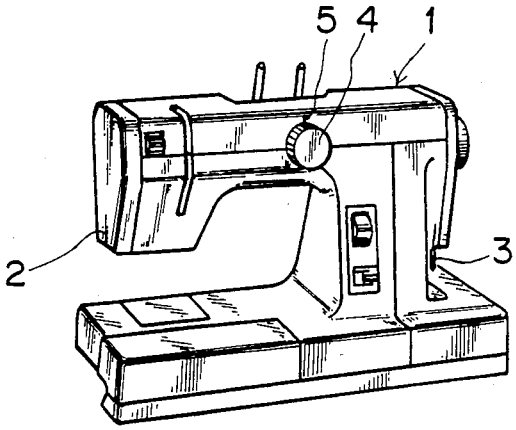
FIG. 10 is a perspective view of a double-function sewing machine.

FIG. 10 shows a perspective view of a double-function sewing machine 1, in which numeral 2 designates a sewing part of a lock stitch mechanism (called a "lock stitching mechanism" hereinafter) which is a second stitching mechanism, while numeral 3 designates a sewing part of an over-lock stitching mechanism (called as "overlock stitch mechanism" hereinafter) which is a first mechanism. These stitch forming mechanisms are alternately selected by operating a selecting dial 4 connected to a switching mechanism which are driven by one drive motor (not shown) via a drive mechanism and a clutch mechanism. Numeral 5 designates an indication mark for selecting stitches shown in the selection dial 4.

Figure 1:
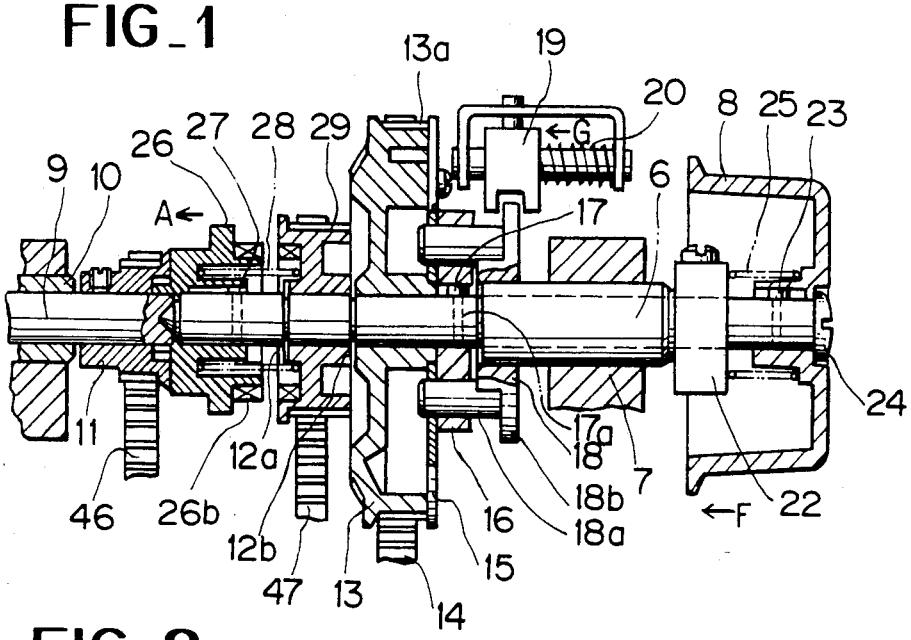
FIG. 1 is a cross sectional view of a selecting device of the present invention.
Figure 2:
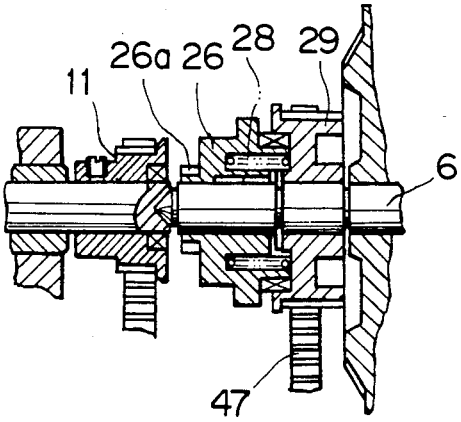
FIG. 2 shows a sectional view of an engagement arrangement when an over-lock stitching is selected.
Figure 11:
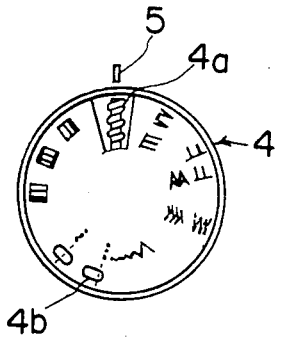
FIG. 11 is a front view of a selecting dial of the device of the present invention.

FIG. 1 is a sectional view of the selecting mechanism, in which a pulley shaft 6 is a drive shaft rotatably supported in a bush 7 secured to a machine frame and is provided with a flywheel 8 at an end thereof extended outwardly of the machine frame.

An upper shaft 9 is rotatably supported in a bush 10 secured to the machine frame adjacent to and coaxial with the pulley shaft 6, and is corrected by a screw with an upper shaft wheel 11 for driving a lower shaft. The upper shaft 9 is provided at its left side with a customary lock stitch mechanism, and is communicated with the lower shaft via a belt 46 connected to the upper belt wheel 11. The lower shaft is conventionally provided at its left side with a customary over-lock stitch mechanism. On the pulley shaft 6, a belt wheel 29 is idle on shaft 6 and which is axially positioned by E-shaped stopper rings 12*a*, 12*b*. A belt 47 connected to said belt wheel 29 is communicated with a customary over-lock stitch mechanism.

A belt wheel body 13 is rotatably mounted on the pulley shaft 6 and is provided with teeth 13*a* for connecting to a driving motor by the belt 14, and is further secured to an engaging plate 15 at its side.

A rotation transmitting ring 16 is mounted on the pulley shaft 6. A key pin 17 is fitted in a hole formed in the pulley shaft 6, and a key groove is formed in the rotation transmitting ring 16. A key portion 17*a* of the key pin 17 is fitted in the key groove, of ring 16 to transmit the rotation of the pulley shaft 6 to the rotation transmitting ring 16.

An axial position of the belt wheel body 13 and the ring 16 is determined by providing members 13 and 16 between the E-ring 12*b* and the side of the bush 7. A clutch body 18 is mounted on an outer circumference of the bush 7 movably in the axial direction, and is normally biased in the direction of arrow A by a spring 20 and a guide 19 for guiding both sides of a disc 18*b* of the clutch body 18.

The clutch body 18 is formed with a clutch pin 18*a* passing through holes of the transmitting ring 16 and of the engaging plate 15 so that the belt wheel body 13 and the pulley shaft 6 are rotated. When the guide 19 is moved in opposition to the arrow A against the spring 20 while the pulley shaft 6 is inoperative, e.g., during the winding of the thread, the clutch pin 18*a* of the clutch body 18 is disengaged from the hole of the engaging plate 15, so that the rotation by the power source is transmitted to only the belt wheel body 15 and this clutch body 18 is rotated on the pulley shaft 6.

The pulley shaft 6 is secured to a disc screw 24 at its end. A spring 25 is provided between a ring 22 fixed to the pulley shaft 6 and the flywheel 8, and normally biases the flywheel 8 to the right side in the axial direction so that the flywheel 8 contacts to a brim portion of the disc screw 24 for positioning.

A slider 26 is mounted on the pulley shaft 6 between the upper shaft belt wheel 11 and the belt wheel 29. A key groove formed in the slider 26 is engaged with a key pin 27 positioned in a hole of the pulley shaft 6, and said engaged arrangement is station-fixed and is movable in the axial direction, and the force of a spring 28 acts toward the upper belt wheel 11. the slider 26 is formed at its both ends with key portions to be fitted in key grooves formed in the belt wheels 11 and 29 respectively.

Figure 3:
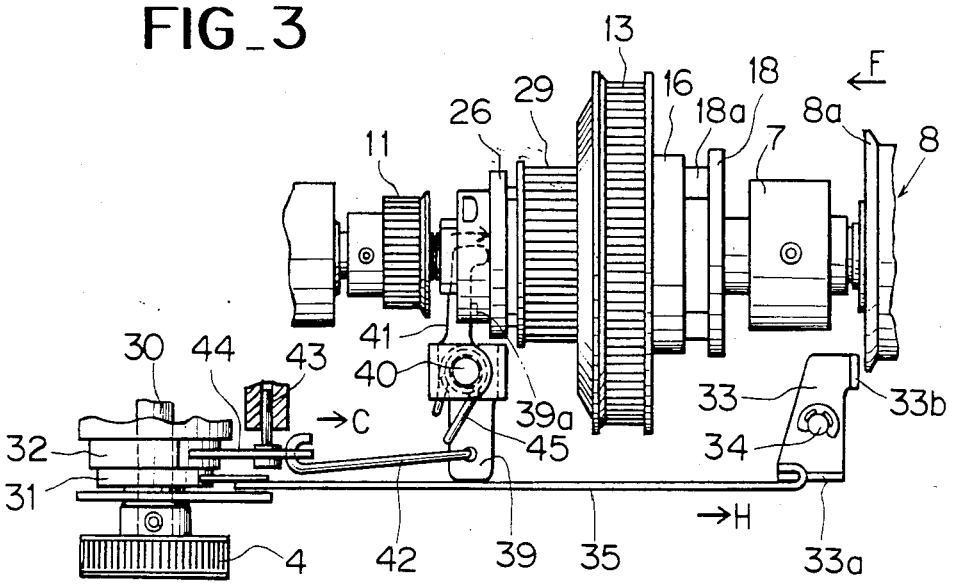
FIG. 3 is a side view of the selecting device.

The selection dial 4 is fixedly mounted on a dial shaft 30 (FIG. 3) supported the the machine frame rotatably. The machine frame is provided on its surface with the indication mark 5 for meeting patterns shown on the selection dial 4. The dial shaft 30 serves as a selection shaft for patterns and also as a switching shaft of the stitch forming mechanism, and is secured to a releasing cam 31 and a switching cam 32 mounted within the machine frame. The switching cam 32 is connected to a pattern selection part at a rear side in the axial direction.

Figure 7:
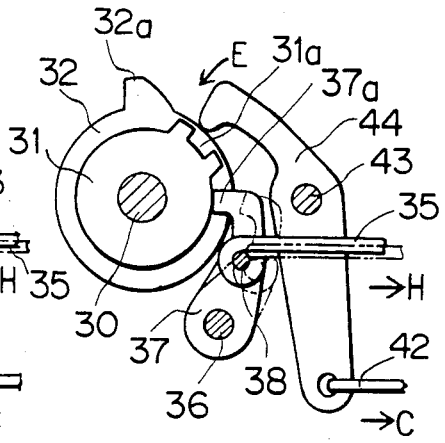
FIG. 7 shows a switching part for selecting a lock stitch.
Figure 9:
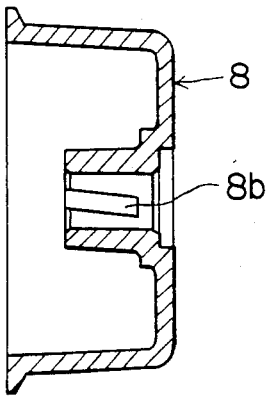
FIG. 9 is a cross sectional view of a flywheel.

A release arm 33 is rotatably supported on a pin 34 fixed to the machine frame and has stands projections, 33*a* and 33*b*. The stand 33*a* is connected to a release rod 35 at its one end, and its other end is, as seen in FIG. 7, connected to a pin 38 held by release stopper 37 rotatably positioned on a pin 36 fixed to the machine frame, so as to rotate the release arm 33 about the pin 34 and accordingly rotate the release stopper 37 about the pin 36 via the pin 34.

The release cam 31 is formed on its outer circumference with a concave 31*a* (FIGS. 7 and 8) for engaging the end of the release stopper 37 when an over-locking pattern 4*a* of the selection dial 4 meets the indication mark 5. The release stopper 37 is biased in the direction of arrow B (FIG. 8) by a spring (not shown), and the end 37*a* is engaged with the outer circumference of the release cam 31.

As shown in FIGS. 3 to 6, a shift lever 39 is rotatably supported on a pin 40 fixed to the machine frame and is provided at its one side with a stand 39*a* for limiting lateral movement of the shift pawl 41 rotatably supported on the pin 40, and its other side is connected to one end of the switching rod 42. The switching rod 42 is connected at its one end to a switching pawl 44 also shown in FIGS. 7 and 8. Pawe 44 is rotatable on a pin 43 fixed to the machine frame, and is normally biased in the direction of arrow E by a spring (not shown) and engaged with the switching cam 32. The switching cam 32 is provided with a convex projection 32*a* for pushing up the switching pawl 44 in the direction opposite to arrow E when the over-locking pattern 4*a* of the dial 4 meets the indication mark 5. The shift pawl spring 45 is engaged with the shift lever 39 and normally biases the shift pawl 41 toward to arrow D.

The actuation of the selecting device is as follows:

At a position, where the lock stitching pattern 4*b* of the selection dial 4 meets the indication mark 5, the release cam 31 and the switching cam 32 are positioned as shown in FIG. 7; the end of the switching pawl 44 is rotated to the arrow E and contacts the flat portion of the switching cam 32 so as to push the switching rod 42 in the direction of arrow C; the shift pawl 41 is rotated in the opposite direction to arrow D by the stand 39*a* of the shift lever 39; the slider 26 is, as seen in FIG. 1, biased in the direction of arrow A by the spring 28; and the key portion 26*a* of the slider 26 is engaged in the key groove of the upper belt wheel 11. Therefore, the rotation is transmitted from the motor as a power source to the belt wheel 13 via the belt 14, so that the pulley shaft 6 is driven via the transmission ring 16 and the clutch pin 17*a* connected to the engaging plate 15 secured to the belt wheel 13. The rotation of the pulley shaft 6 causes rotation of the slider 26 via the key pin 27, and the lock-stitch mechanism is driven by the upper belt wheel 11 and the upper shaft 9. The fly-wheel 8 is rotated by the pin key 23 integral with the pulley shaft 6.

With respect to forming the over-lock stitches, the flywheel 8 is moved in the direction of arrow F against the force of the spring 25, and the edge 8*a* of the flywheel 8 contacts the stand 33*b* of the release arm 33, and the flywheel 8 is pushed inward axially to push the stand 33*a* and rotate the release arm 33 about the pin 34. The release rod 35 is moved in the direction of arrow H so that the release stopper 37 is positioned, as shown with the dotted line, in FIG. 8 to release the engagement between the release cam 31 and the release stopper 37 and allow the rotation of the dial shaft 30.

Figure 4:
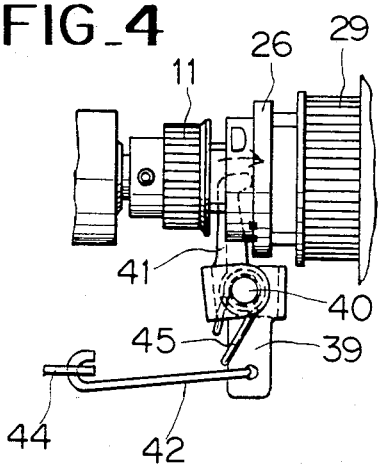
FIG. 4 shows a selecting device in a selecting condition.
Figure 5:
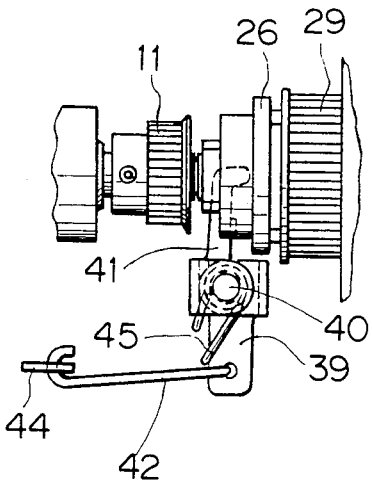
FIG. 5 shows a selecting device in an actuation position.
Figure 6:
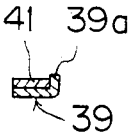
FIG. 6 shows an engagement of a shift lever with a shift pawl.
Figure 8:
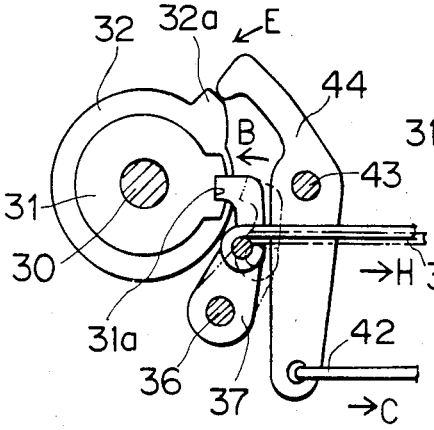
FIG. 8 shows a switching part for selecting an over-lock stitch.

Subsequently, the selection dial 4 is rotated to cause the over-locking pattern 4*a* to meet the indication mark 5. By the rotation of the dial shaft 30, the release cam 31 and the switch cam 32 are positioned as illustrated in FIG. 8. The switching pawl 44 for the switching cam 32 is rotated in opposition to the arrow E by the convex projection 32*a* and pulls the switching rod 42 in opposition to the arrow C. Therefore, the shift lever 39 is rotated about the pin 40 as seen in FIG. 4, and there appears a space for allowing the rotation of the shift pawl 41 between the stand 39*c* and the shift pawl 41. Since the shift pawl 41 is normally biased toward the arrow D by a shift pawl spring 45, the slider 26 is pushed in the direction of arrow D. The slider 26 is moved in the axial direction and releases the connection between the key groove of the upper shaft belt wheel 11 and the key portion, so that the key portion 26b of the slider 26 is connected with the key groove of the belt wheel 29 as shown in FIG. 5.

At a position, where the key portion 26b of the slider 26 does not coincide with the key groove of the belt wheel 29, the shift pawl 41 is effected with the pressure of shift pawl spring 45 as shown in FIG. 4. If the pulley shaft 6 is manually rotated by the flywheel 8, or the motor is driven, the slider 26 is moved in the axial direction by the shift pawl 41 by the pressure of the pawl spring 45 at the position where the key portion 26b of the slider 26 coincides with the key groove of the belt wheel 29 as shown in FIG. 5.

The rotation is transmitted to the belt wheel 13 via the belt 14 from the motor as a drive source, and the pulley shaft 6 is driven by the transmission ring 16 and the clutch pin 17a connected with the engaging plate 15 secured to the belt wheel.

The pulley shaft 6 rotates the slider 26 via the key pin 27 and the belt wheel 29 is rotated thereby, and the over-lock stitch mechanism is driven through the belt 47.

When the selection is completed by the dial 4 and the pressure to the flywheel 8 is cancelled, the flywheel 8 is moved to the end of the shaft by the spring 25. The release stopper 37 engages at its end portion in the concave 31a of the release cam 31 and limits the rotation of the selection dial 4 as seen in FIG. 8.

For axially moving the slider 26 when switching, it is necessary to release the slider 26 from the key portion and the upper shaft belt wheel 11 or the belt wheel 29 from the key groove, however it is not easy to provide said releasing due to pressing friction between the key portion of the slider and the key groove with respect to the driving direction. Therefore, key groove 8b of the flywheel 8 is fitted for the key pin 23 of the pulley shaft 6 and provided in the direction in opposition to the rotation direction, the key pin 23 of the pulley shaft 6 being guided in the groove cam of the key groove by moving the fly-wheel 8 in the axial direction (the arrow F), and the key pin 23 is slightly rotated in the opposition to the rotating direction. This rotation releases the connection between the key portion of the slider 26 and the key groove of the upper belt wheel 11 or the belt wheel 29.

It will be understood that each of the elements described above, or two or more together, may also find a useful application in other types of selecting mechanism for double-function sewing machines.

While the invention has been illustrated and described as embodied in a selecting mechanism for a double-function sewing machine, it is not intended to be limited to the details shown, since various modifications and structural changes may be without departing in any way from the spirit of the present invention.

Without further analysis, the foregoing will so fully reveal the gist of the present invention that others can, by applying current knowledge, readily adapt it for various applications without omitting features that, for the standpoint of prior art, fairly constitute essential characteristics of the generic or specific aspects of this invention.

What is claimed as new and desired to be protected by Letters Patent is set forth in the appended claims.

What is claimed is:

1. A selecting mechanism for a double-function sewing machine which is provided with two stitching mechanisms for different sewing operations within a single machine frame, the selecting mechanism comprising a drive shaft (6) which is rotatably supported on the machine frame and is connected at one end with an axially movable flywheel and is driven by a drive source via a belt wheel body; a first belt wheel (29) which is idle rotatably on the drive shaft and is operatively connected to a first stitching mechanism; an upper shaft belt wheel (11) which is secured on an upper shaft (9) of a second stitching mechanism, said upper shaft being rotatably supported in the machine frame and being coaxial with the drive shaft and having a rotation transmitting part; a slider (26) provided on said drive shaft between said upper shaft belt wheel (11) and said first belt wheel (29), said slider having a rotation transmitting part for selectively engaging either of the belt wheels, said slider being rotation-fixed with the drive shaft and movable in an axial direction of the drive shaft; a switching shaft (30) which is rotatably supported in the machine frame and is rotated by an external switching operation; moving means for moving the slider so as to connect the slider to the switching shaft; rotation checking means checking the rotation of for the switching shaft; and a release device which releases the rotation checking means by axially moving the flywheel.

2. A device as claimed in claim 1, wherein a spring means is provided between the slider and the upper shaft belt wheel for providing a connection between said rotation transmitting part of the slider and the upper shaft belt wheel so as to move the slider when the second stitching mechanism is selected by the switching operation.

3. A device as claimed in claim 2, further comprising a shift lever (39) which causes the moving means to move the slider against the spring means when the first stitching mechanism is selected by the switching operation, a shift pawl (41) rotatably engaging the shift lever, and a pawl spring (45) causing the shift pawl to contact the slider.

4. A device as claimed in claim 3, wherein the moving means is provided at the shift lever with a shift pawl engaging portion which causes the shift pawl to actuate the shift lever against the pawl spring when the second stitching mechanism is selected by the selecting operation.

5. A device as claimed in claim 1, wherein the flywheel is provided with a key groove extending in the axial direction and a rotating direction so as to be fitted with a key provided on the drive shaft for rotating the drive shaft in an opposite direction to the driving direction thereof.

* * * * *